US005944273A

United States Patent [19]

Lin et al.

[11] Patent Number: 5,944,273

[45] Date of Patent: Aug. 31, 1999

[54] PARENT ROLL FOR TISSUE PAPER

[75] Inventors: Philip Sim Lin, Oshkosh; Randall James LeValley, Neenah, both of Wis.; Brian Douglas Klaubert, Aiken, S.C.; Ronald Frederick Gropp, St. Catharines, Canada; Tommy Rolf Karlsson, Gothenburg; Bernt Erik Ingvar Klerelid, Karlstad, both of Sweden

[73] Assignee: Kimberly-Clark Worldwide, Inc., Neenah, Wis.

[21] Appl. No.: 08/887,922

[22] Filed: Jul. 3, 1997

[51] Int. Cl.[6] ..... B65H 18/28

[52] U.S. Cl. ..... 242/160.4

[58] Field of Search ..... 242/160.4; 206/233, 206/359

[56] References Cited

U.S. PATENT DOCUMENTS

| | | | |
|---|---|---|---|
| 3,442,463 | 5/1969 | Pointe | 242/64 |
| 4,143,828 | 3/1979 | Braun et al. | 242/65 |
| 4,179,330 | 12/1979 | Page | 162/113 |
| 5,069,548 | 12/1991 | Boehnlein | 356/376 |
| 5,375,790 | 12/1994 | Svanqvist | 242/541.1 |
| 5,591,309 | 1/1997 | Rugowski et al. | 162/283 |
| 5,607,551 | 3/1997 | Farrington, Jr. et al. | 162/112 |
| 5,673,870 | 10/1997 | Fiedling et al. | 242/542.3 |
| 5,695,607 | 12/1997 | Oriaran et al. | 162/112 |

FOREIGN PATENT DOCUMENTS

| | | | |
|---|---|---|---|
| 2 303 647 | 2/1997 | United Kingdom | D21H 21/20 |

OTHER PUBLICATIONS

Alvertos, Nicolas, "Integration of Stereo Camera Geometries," *Optics, Illumination and Image Sensing for Machine Vision IV,* SPIE, vol. 1194, 1989, pp. 276–286.

American Society for Testing Materials (ASTM) Designation: D 737–96, "Standard Test Method for Air Permeability of Textile Fabrics," pp. 236–240, published Apr. 1996.

Ericksson, L. "Deformations in Paper Rolls," *Advances and Trends in Winding Technology: Proceedings of the First International Conference on Winding Technology,* Stockholm, Sweden, Mar. 1987, pp. 55–61.

Farago, F. T. and M. A. Curtis, "Handbook of Dimensional Measurement," Third Edition, Industrial Press Inc., New York, 1994, pp. 428–436.

Gilmore, W. J., "Report on Roll Defect Terminology—TAPPI CA 1228," *TAPPI 1973 Finishing Conference,* Nov. 11–14, 1973, pp. 5–19.

Good, James K., "The Science of Winding Paper Rolls," *Products of Papermaking: Transactions of the Tenth Fundamental Research Symposium Held at Oxford: Sep. 1993,* vol. 2, pp. 855–881.

Harding, Kevin, "Moire Interferometry for Industrial Inspection," *Lasers & Applications,* Nov. 1983, pp. 73–78.

Lemke, R.J., J. Uotinen, and H. Oinonen, "Factors Involved in Winding Large Diameter Newsprint Rolls on a Two–Drum Winder," *Advances and Trends in Winding Technology: Proceedings of the First International Conference on Winding Technology,* Stockholm, Sweden, Mar. 1987, pp. 79–87.

(List continued on next page.)

*Primary Examiner*—Katherine A. Matecki
*Assistant Examiner*—Minh-Chau Pham
*Attorney, Agent, or Firm*—Gregory E. Croft

[57] ABSTRACT

A uniformly wound parent roll of soft, high bulk tissue has greater uniformity in sheet basis weight, machine direction stretch and bulk when compared to parent rolls wound by conventional winding methods. The method involves carrying the tissue sheet on a relatively air impermeable transfer belt which traverses an unsupported span between two winding drums. The sheet is transferred from the transfer belt to the parent roll as the parent roll is urged against the sheet/transfer belt at a point within the unsupported span. The resulting deflection of the transfer belt is detected and, in response, the reel spool position is controllably changed to maintain the deflection within predetermined limits. The tension of the sheet is controlled by the predetermined differential speed between the outer most surface of the parent roll and the transfer belt.

7 Claims, 3 Drawing Sheets

OTHER PUBLICATIONS

Lippert, Thomas M., "Radial Parallax Binocular 3–D Imaging," *Display System Optics II,* SPIE vol. 1117, Mar. 30–31, 1989, pp. 52–55.

Lynnworth, Lawrence C., "Ultrasonic Measurements for Process Control," Academic Press, Inc., Boston, 1989, pp. 63–65 and 525–531.

Svanqvist, Tord, "Designing a Reel for Soft Tissue," *Paper Technology: 1991 Tissue Making Seminar, Karlstad, Sweden,* Dec. 1991, pp. 8–11.

PARENT ROLL FOR TISSUE PAPER

BACKGROUND OF THE INVENTION

In the manufacture of various types of tissue products such as facial tissue, bath tissue, paper towels and the like, the dried tissue web or sheet coming off of the tissue machine is initially wound into a parent roll and temporarily stored for further processing. Sometime thereafter, the parent roll is unwound and the sheet is converted into a final product form.

In winding the tissue web into a large parent roll, it is vital that the roll be wound in a manner which prevents major defects in the roll and which permits efficient conversion of the roll into the final product, whether it be boxes of facial tissue sheets, rolls of bath tissue, rolls of embossed paper towels, and the like. Ideally, the parent roll has an essentially cylindrical form, with a smooth cylindrical major surface and two smooth, flat, and parallel end surfaces. The cylindrical major surface and the end surfaces should be free of ripples, bumps, waviness, eccentricity, wrinkles, etc., or, in other words, the roll should be "dimensionally correct". Likewise, the form of the roll must be stable, so that it does not depart from its cylindrical shape during storage or routine handling, or, in other words, the roll should be "dimensionally stable". Defects can force entire rolls to be scrapped if they are rendered unsuitable for high speed conversion.

Many defects can be introduced by improper winding, especially when winding high bulk, easily-compressible, soft tissue webs. A large number of such defects are discussed and shown in photographs in an article by W. J. Gilmore, "Report on Roll Defect Terminology –TAPPI CA1228", Proc. 1973 Finishing Conference, Tappi, Atlanta, Ga., 1973, pp. 5–19; Inadequate web stress near the core of the roll may cause the outer regions of the roll to compress the roll inwardly, leading to buckling in a starred pattern, commonly called "starring", as described by James K. Good, "The Science of Winding Rolls", *Products of Papermaking, Trans. of the Tenth Fundamental Research Symposium at Oxford*, Sep. 1993, Ed. C. F. Baker, Vol. 2, Pira International, Leatherhead, England, 1993, pp. 855–881. Furthermore, starring causes the release of the tension of the web around the core that normally provides sufficient friction between the core and adjacent layers of the web. This loss of friction can result in core "slipping" or "telescoping", where most of the roll (except for a few layers around the core and a few layers around the outermost regions) moves en mass to one side with respect to the axis of the roll, rendering the roll unusable.

Current commercially available hard nip drum reels of the type with center-assisted drives, as described by T. Svandquist, "*Designing a Reel for Soft Tissue*", 1991 Tissue Making Seminar, Karlstad, Sweden, have been successfully used to wind rolls of compressible tissue webs having bulks of up to about 8 to 10 cubic centimeters per gram, while avoiding the above-mentioned winding problems, by reducing the nip force and relying mainly on the in-going web tension control through modulation of the center-assisted drive for the coreshaft. However when using such methods to wind tissue sheets having high bulk, such as those having a bulk of about 9 cubic centimeters per gram or higher, and a high level of softness, as characterized, for example, by an MD Max Slope of about 10 kilograms or less per 3 inches of sample width, these problems will recur. These winding problems are accentuated when attempting to wind large rolls with diameters from about 70 inches to about 150 inches or greater, particularly at high speeds.

Without wishing to be bound by theory, it is believed that when a web is brought into a nip formed between the parent roll and a pressure roll, two major factors besides the in-going web tension affect the final stresses inside a wound roll. Firstly, the portion of the parent roll in the nip is deformed to a radius which is smaller than the undeformed radius of the parent roll. The expansion of the parent roll from its deformed radius to its undeformed radius stretches the web and results in a substantial internal tension increase from the set tension of the web going into the nip. Another factor is sometimes called the "secondary winding" effect. A portion of the web is added to a roll after it passes first through the nip between the parent roll and the pressure roll. It then passes under the nip repeatedly at each rotation of the parent roll while more layers are added on the outer diameter. As each point near the surface of the roll reenters the nip, the web is compressed under the nip pressure, causing air in the void volume of the web to be expelled between the layers. This can reduce the friction between the layers sufficiently to allow the layers to slide tighter around the inner layers, as described by Erickkson et al., *Deformations in Paper Rolls*, pp 55–61 and Lemke, et al., *Factors involved in Winding Large Diameter Newsprint Rolls on a Two-Drum Winder*, pp 79–87 *Proc of the First International Conference on Winding Technology*, 1987. The tension in each layer as it is added to the parent roll causes a compression force exerted by the outer layer to the layers underneath, thus the cumulative effect of compression from the outer layers will normally cause the web at the region around the core to have the highest interlayer pressure. The secondary winding further adds to this pressure. Soft tissue is known to yield when subjected to compression, thus absorbing some of the increases in pressure to the extent that it loses its ability to deform. Consequently, the cumulative pressure can rise at a steep rate to excessive levels that can cause a wide variation in the sheet properties unwound from the parent rolls.

Unfortunately, the internal pressure and web tension gradient that exists along the radius of a conventionally wound parent roll, while successful in preventing dimensional stability problems, lead to undesired variability in the properties of the web. High tension in some regions causes some of the machine direction stretch to be pulled out during winding, and high internal pressure results in loss of bulk. Upon unwinding, regions that have been stretched more by high tension in and after the nip will have lower basis weight because of longitudinal stretching of the web. These changes in crucial web properties lead to variability in product quality and difficulties in converting operations.

Compensating for the internal pressure build-up, according to the above-mentioned method described by T. Svandquist, can be carried only to a certain extent. As the density and strength of the web material is reduced much lower than the levels cited, uncertainties in the magnitude of frictional forces and other factors which change during the course of winding a roll make precise nip loading control very difficult. Alternatively, loss of control of the winding process can result in a reversal in tension gradient that can lead to the starring and core slippage problems described above.

If it were no longer necessary to use a hard nip in reeling of the tissue web, many of these problems could be avoided and better control of true web tension in the roll could be maintained for bulky, deformable materials. Pure center winding without a nip is known for some delicate materials, but in this case high web tension would be needed to apply adequate presure in the roll and machine direction stretch would be reduced. With pure center winding, tension near the core needs to be higher to prevent telescoping of the roll and other defects. Pure center winding also suffers from speed limitations. At higher speeds, web tension would be too high and sheet flutter would lead to breaks and poor reeling.

Most tissue machines in commercial operation have what is termed an "open draw" between the dryer and the reel, meaning the dried sheet is unsupported over the distance between the dryer and the reel. More recently, in an effort to improve productivity by reducing sheet breaks in manufacturing, a tissue machine has been designed to include a supporting fabric for carrying the dried sheet from the dryer to the reel without an open draw. Such a machine, as disclosed in U.S. Pat. No. 5,591,309 to Rugowski et al., entitled "Papermaking Machine For Making Uncreped Throughdried Tissue Sheets", illustrates a hard nip between the reel spool or the parent roll and the winding drum to effect transfer of the sheet from the fabric to the reel or the parent roll. For many tissue sheets, the presence of the hard nip at this point in the process is not a problem because the sheet is relatively dense and can withstand the amount of compression it experiences without detriment to final product quality. However, for some recently developed tissue sheets, particularly soft, high bulk uncreped throughdried tissue sheets as disclosed in U.S. Pat. No. 5,607,551 to Farrington, Jr. et al., it has been found that traditional winding methods are unable to reliably produce a parent roll with appropriate web tension and radial pressure throughout to yield an unwound sheet of substantial uniformity.

Therefore there is a need for a method of winding soft, bulky tissue sheets in which the variability in sheet bulk, caliper, machine direction stretch and/or basis weight is minimized, while still maintaining parent roll characteristics that are favorable to manufacturing and converting operations.

SUMMARY OF THE INVENTION

It has now been discovered that soft, bulky tissue sheets can be wound onto a parent roll with minimal sheet degradation by carrying the sheet from the dryer to a motor driven reel spool while supported by a transfer belt, which preferably has little or no air permeability. The transfer belt traverses an unsupported or free span between two winding drums and transfers the sheet to the reel or parent roll at a point where the transfer belt is no longer in contact with the winding drums, generally at a point along the unsupported span about midway between the winding drums. At the point of transfer, the reel spool or the parent roll is urged only slightly against the sheet/transfer belt such that the transfer belt is slightly deflected or bowed. It has been found that the degree of deflection is an important variable that must be controlled to improve the uniformity of the sheet throughout the resulting parent roll. Control of the deflection is preferably attained by directing a laser or other distance measuring device(s) at the underside of the transfer belt to detect and measure the degree to which the transfer belt is deflected at the point of sheet transfer. If the transfer belt is deflected beyond a predetermined limit, the position of the reel spool relative to the transfer belt is adjusted to either increase or decrease the distance between the reel spool and the transfer belt. By controlling this distance to a small value during the entire time the parent roll is building, the nip force between the parent roll and the surface of the transfer belt is minimized to a level much lower than can be attained from the hard nip of the pressure roll. This in turn eliminates the effects of nip stretching and secondary winding while allowing the web tension dictated by the center drive system to be a bigger factor in controlling the interlayer tension in the roll. The uncertainties associated with measuring small nip forces and changing bearing friction during the building of the roll is completely obviated. Parent rolls wound on a winder in accordance with this invention have an internal pressure distribution such that the peak pressure at the core region reaches values lower than those attained from a conventional reel, yet which are sufficient to maintain the mechanical stability required for normal handling. The parent rolls from the method of this invention have an internal pressure near the core which decreases to a certain level and then displays a significant region with an essentially flat pressure profile, except for the inevitable drop to low pressure at the outer surface of the roll. Thus, the uniformity of sheet properties throughout the parent roll is substantially improved.

More specifically, the method of winding a dry high bulk tissue web onto a center-wound, power driven reel spool to form a parent roll includes the steps of: (a) supporting the dry tissue web on a moving endless transfer belt which carries the tissue web to the parent roll and which traverses an unsupported span between two winding drums; (b) transferring the tissue sheet, while supported by the transfer belt in the span between the two winding drums, to the parent roll such that the path of the transfer belt is deflected by the surface of the parent roll; (c) sensing the extent to which the transfer belt is deflected with a sensing device; and (d) adjusting the relative position of the reel spool and the transfer belt in response to the extent to which the transfer belt is deflected by the parent roll. Adjusting the relative positions of the reel spool and the transfer belt can be attained by either moving the reel spool shaft or the transfer belt through its support mechanisms. In adjusting the relative position of the transfer belt and the reel spool, the radius of the building roll can be calculated by direct measurement or by means of the relative position of the reel spool shaft from its initial starting position and the transfer belt deflection.

Control of the web properties of the web unwound from the parent roll can be aided by imparting a predetermined amount of web tension to the incoming web, such as by programming the level of speed difference between the transfer belt and the outer surface of the building parent roll. In most instances, a positive draw is required at the parent roll in order to impart the web tension needed to provide a stable parent roll. On the other hand, too much positive draw will unacceptably reduce the machine direction stretch in the web. Therefore, the amount of positive draw (the percentage by which the speed of the surface of the parent roll exceeds the speed of the transfer belt) will depend upon the web properties coming into the parent roll and the desired properties of the web to be unwound from the parent roll. Generally, the speed of the surface of the parent roll will be about 10 percent or less faster than the speed of the transfer belt, more specifically from about 0.5 to about 8 percent faster, and still more specifically from about 1 to about 6 percent faster. Of course, if the web approaching the parent roll already has sufficient tension provided by other means earlier in the tissue making process, a negative or zero draw may be desirable.

Hence in one aspect, the invention resides in a parent roll of high bulk tissue having a diameter of about 70 inches or greater, wherein the bulk of the tissue taken from the roll is about 9 cubic centimeters per gram or greater, the coefficient of variation of the finished basis weight is about 2% or less and the coefficient of variation of the machine direction stretch is about 6% or less. In addition, the coefficient of variation of the sheet bulk for tissue sheets taken from the parent roll can be about 3.0 or less.

More specifically, the diameter of the parent roll can be from about 100 to about 150 inches or greater. The coefficient of variation of the finished basis weight can be about 1% or less. The coefficient of variation of the machine direction stretch can be about 4% or less, still more specifically about 3% or less. The coefficient of variation of the sheet bulk can be about 2.0 or less.

As used herein, high bulk tissues are tissues having a bulk of about 9 cubic centimeters or greater per gram before calendering. Such tissues are described in U.S. Pat. No. 5,607,551 issued Mar. 4, 1997 to Farrington, Jr. et al. entitled "Soft Tissue", which is herein incorporated by reference. More particularly, high bulk tissues for purposes herein can be characterized by bulk values of from 10 to about 35 cubic centimeters per gram, more specifically from about 15 to about 25 cubic centimeters per gram. The method for measuring bulk is described in the Farrington, Jr. et al. patent. In addition, the softness of the high bulk tissues of this invention can be characterized by a relatively low stiffness as determined by the MD Max Slope and/or the MD Stiffness Factor, the measurement of which is also described in the Farrington, Jr. et al. patent. More specifically, the MD Max Slope, expressed as kilograms per 3 inches of sample, can be about 10 or less, more specifically about 5 or less, and still more specifically from about 3 to about 6. The MD Stiffness Factor, expressed as (kilograms per 3 inches)-microns$^{05}$, can be about 150 or less, more specifically about 100 or less, and still more specifically from about 50 to about 100. Furthermore, the high bulk tissues of this invention can have a machine direction stretch of about 10 percent or greater, more specifically from about 10 to about 30 percent, and still more specifically from about 15 to about 25 percent. In addition, the high bulk tissues of this invention suitably can have a substantially uniform density since they are preferably throughdried to final dryness without any significant differential compression.

Suitable non-contacting and contacting sensing devices useful for purposes herein are well known in the art. Several are described by F. T. Farago and M. A. Curtis in *Handbook of Dimensional Measurements,* 3rd ed., Industrial Press, Inc., New York, 1994. Such methods include laser-based distance or depth sensing devices using techniques such as laser triangulation; laser white light or multiple wavelength moire interferometry, as illustrated by Kevin Harding, "Moire Inteferometry for Industrial Inspection," *Lasers and Applications*, Nov. 1993, pp. 73–78, and Albert J. Boehnlein, "Field Shift Moire System," U.S. Pat. No. 5,069,548, Dec. 3, 1991; ultrasonic sensing, including methods described in L. C. Lynnworth, *Ultrasonic Measurements for Process Control*, Academic Press, Boston, 1989, and particularly the method of measuring the delay time for an ultrasonic signal reflected off a solid surface; microwave and radar wave reflectance methods; capacitance methods for determination of distance; eddy current transducer methods; single-camera stereoscopic imaging for depth sensing, as illustrated by T. Lippert, "Radial parallax binocular 3D imaging" in Display System Optics II, Proc. SPIE Vol. 1117 pp. 52–55 (1989); multiple-camera stereoscopic imaging for depth sensing, as illustrated by N. Alvertos, "Integration of Stereo Camera Geometries" in Optics, Illumination and Image Sensing for Machine Vision IV., Proc. SPIE, Vol. 1194, pp. 276–286 (1989); contacting probes such as rollers, wheels, metal strips, and other devices whose position or deflection is measured directly; and the like. A particularly suitable sensing device is a laser displacement sensor, Model LAS-8010, manufactured by Nippon Automation Company, Ltd. and distributed by Adsens Tech Inc.

The extent to which the transfer belt is deflected is suitably maintained at a level of about 20 millimeters or less, more specifically about 10 millimeters or less, still more specifically about 5 millimeters or less, and still more specifically from about 1 to about 10 millimeters. Deflection is measured perpendicular to the unobstructed line of travel of the transfer belt. The acceptable amount of deflection for any given tissue sheet is in part determined by the design of the transfer belt and the tension imparted to the transfer belt during operation. As the tension is reduced, the acceptable amount of deflection will increase because the compression of the sheet is reduced and the amount of power transferred to the parent roll is reduced. In turn, the variability in the properties of the wound sheet is reduced. Preferably the deflection of the transfer belt is kept to a small amount so that the power transferred from the belt to the building roll, or vice versa, is about 10% of the center drive motor load or less, more specifically about 5% or less, still more specifically about 2% or less and even more specifically about 1% or less.

The transfer belt deflection control preferably uses one or more laser distance sensors that determine the indentation of the parent roll into the surface of the belt and then position the movable linear carriages that hold and support the parent rolls to maintain this indentation at a constant level. The laser sensor can be positioned to always measure the deflection of the transfer belt at the midpoint of the free span, regardless of the parent roll position, and the actual deflection can be calculated as described below. Alternatively, the laser sensor can traverse the free span with the parent roll nip such that the laser always measures the deflection directly. The control system preferably maintains the actual transfer belt deflection at the nip at a level of about 4 mm. ±2 mm. The laser sensor can be a Nippon Automation LAS 8010 sensor that has a focused range of 140 to 60 mm. The front plate of the sensor can be mounted 120 mm. from the inside surface of the transfer belt. Such a sensor is designed to give a 4 to 20 ma. output in relation to the minimum to maximum distance between the sensor and the transfer belt. The winder is then operated without a roll loaded against the transfer belt to set the zero point in the programmable logic controller.

In the situation where the laser position is fixed at the midpoint of the free span and a deflection is measured by the laser at that point, the actual deflection at the parent roll nip point is calculated according to the position-of the building parent roll, which traverses from one end of the open span to the other while it builds. Since the laser is mounted in the middle of the free span of the transfer belt between the two winding drums and only measures the deflection of the transfer belt at that position, the actual deflection at the nip is closely approximated by the measured deflection in the middle of the free span times the ratio of the distance from the laser measurement point to the nip point of the winding drum nearest the nip point of the parent roll divided by the distance from the nip point of the parent roll to the nip point of that same winding drum. For purposes of this calculation, the nip points of the winding drums are the tangent points at which the undeflected line of travel of the transfer belt in the free span contacts the winding drums. The nip point of the parent roll is the midpoint of the wrap of the transfer belt around the periphery of the parent roll. This is illustrated in FIG. 3, where the actual deflection "D", is the measured deflection at point M (the midpoint of the free span) times the ratio of the distance MA to the distance CA. If the parent roll were precisely in the middle of the free span, the ratio would be 1 and the laser would be measuring the actual deflection "D". However, when the parent roll is positioned on either side of the midpoint of the free span, the deflection of the transfer belt measured by the laser at the midpoint is always less than the actual deflection at the transfer point.

Once the transfer belt deflection has been measured, a proportional only control loop maintains that deflection at a constant level. The output of this control is the setpoint for a hydraulic servo positioning control system for the carriages holding the building parent roll. When the transfer belt deflection exceeds the setpoint, the carriage position setpoint is increased, moving the carriages away from the fabric to return the deflection back to the setpoint. A specific hydraulic servo positioning system consists of Moog servo valves controlled by an Allen-Bradley QB module with Temposonic transducers mounted on the rods of the hydraulic cylinders to determine position. The output from the deflection control loop is the input to two individual servo positioning systems on either side of the reel. Each system can then control, keeping the two sides of the reel parallel. There should be a protection system that stops the operation if the parallelism is lost, but it is not necessary to have an active system to keep the two sides parallel.

The air permeability of the transfer belt can be about 100 cubic feet per minute per square foot of fabric or less, more specifically from about 5 to about 50 cubic feet per minute per square foot, and still more specifically from about 0 to about 10 cubic feet per minute per square foot. Air permeability, which is the air flow through a fabric while maintaining a differential air pressure of 0.5 inch water across the fabric, is described in ASTM test method D737. In addition, the transfer belt is preferably smoother than the throughdrying fabric in order to enhance transfer of the sheet.

The length of the unsupported span between the winding drums needs to be long enough to allow the new reel spool to be placed between the first or upstream winding drum and the fully-built parent roll. On the other hand, the free span needs to be short enough to prevent sagging of the fabric so that the amount of tension can be minimized and the degree of deflection can be controlled. A suitable free span length can be from about 1 to about 5 meters, more specifically from about 2 to about 3 meters.

As mentioned previously, an advantage of this method is the resulting improved uniformity in the sheet properties unwound from the parent roll. Very large parent rolls can be wound while still providing substantial sheet uniformity due to the control of the winding pressure on the sheet. Furthermore, soft, high bulk tissue sheets can be wound into parent rolls at high speeds. Suitable machine speeds can be from about 3000 to about 6000 feet per minute or greater, more specifically from about 4000 to about 6000 feet per minute or greater, and still more specifically from about 4500 to about 6000 feet per minute.

DETAILED DESCRIPTION OF THE DRAWING

Figure 1:
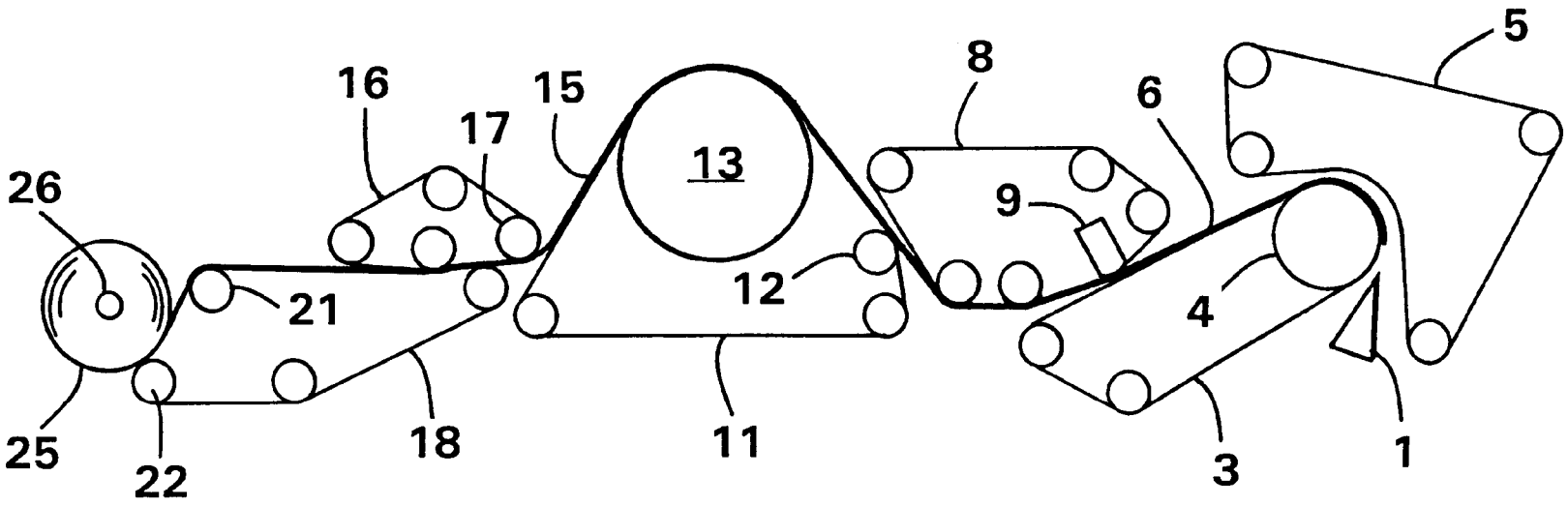
FIG. 1 is a schematic process flow diagram of a method for making soft high bulk tissue sheets in accordance with this invention.

Referring to FIG. 1, shown is a schematic flow diagram of a throughdrying process for making uncreped throughdried tissue sheets. Shown is the headbox 1 which deposits an aqueous suspension of papermaking fibers onto an inner forming fabric 3 as it traverses the forming roll 4. Outer forming fabric 5 serves to contain the web while it passes over the forming roll and sheds some of the water. The wet web 6 is then transferred from the inner forming fabric to a wet end transfer fabric 8 with the aid of a vacuum transfer shoe 9. This transfer is preferably carried out with the transfer fabric traveling at a slower speed than the forming fabric (rush transfer) to impart stretch into the final tissue sheet. The wet web is then transferred to the throughdrying fabric 11 with the assistance of a vacuum transfer roll 12. The throughdrying fabric carries the web over the throughdryer 13, which blows hot air through the web to dry it while preserving bulk. There can be more than one throughdryer in series (not shown), depending on the speed and the dryer capacity. The dried tissue sheet 15 is then transferred to a first dry end transfer fabric 16 with the aid of vacuum transfer roll 17. The tissue sheet shortly after transfer is sandwiched between the first dry end transfer fabric and the transfer belt 18 to positively control the sheet path. The air permeability of the transfer belt is lower than that of the first dry end transfer fabric, causing the sheet to naturally adhere to the transfer belt. At the point of separation, the sheet follows the transfer belt due to vacuum action. Suitable low air permeability fabrics for use as transfer belts include, without limitation, COFPA Mononap NP 50 dryer felt (air permeability of about 50 cubic feet per minute per square foot) and Asten 960C (impermeable to air). The transfer belt passes over two winding drums 21 and 22 before returning to pick up the dried tissue sheet again. The sheet is transferred to the parent roll 25 at a point between the two winding drums. The parent roll is wound onto a reel spool 26, which is driven by a center drive motor.

Figure 2:
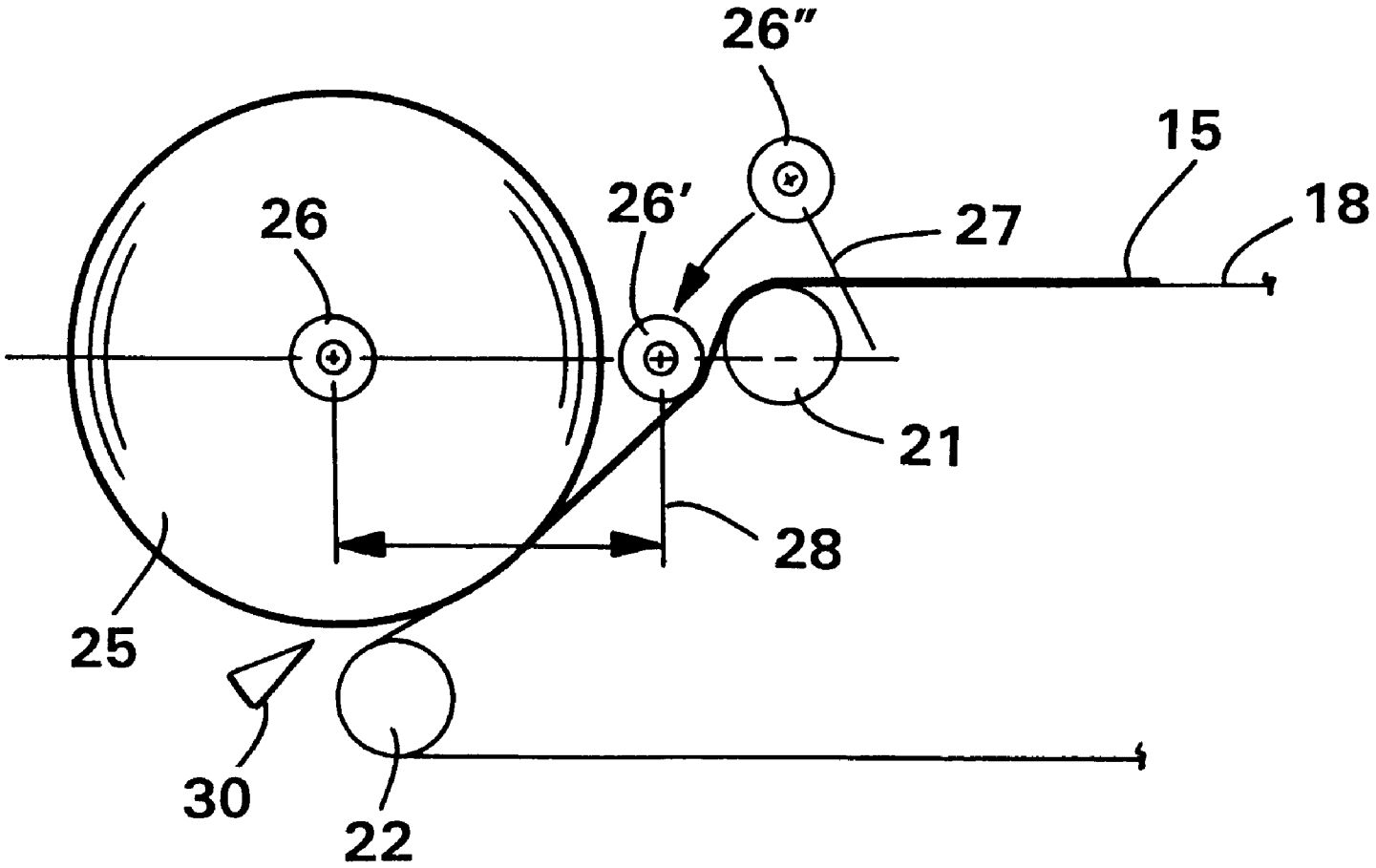
FIG. 2 is a schematic diagram of the winding section of the method illustrated in FIG. 1.

Referring to FIG. 2, the transfer and winding of the sheet is illustrated in more detail. In the free span between the two winding drums, the sheet 15 contacts and transfers to the parent roll 25. Reference numbers 26, 26' and 26" illustrate three positions of the reel spool during continuous operation. As shown, a new reel spool 26" is ready to advance to position 26' as the parent roll 25 is building. When the parent roll has reached its final predetermined diameter, the new reel spool is lowered by arm 27 into position 26' against the incoming sheet at some point along the free span between the winding drums, generally relatively close to the first winding drum 21, thereby avoiding a hard nip between the winding drum and the reel spool. The reel spool is supported appropriately by support arms 28. As the parent roll builds, the reel spool moves toward the other winding drum 22 while at the same time moving away from the transfer belt. The reel spool can be moved in either direction as illustrated by the double-ended arrow to maintain the proper transfer belt deflection needed to minimize the variability of the sheet properties during the winding process. As a result, the parent roll nip substantially traverses the free span as the roll builds to its predetermined size. At the appropriate time, one or more air jets 30 serve to blow the sheet back toward the new reel spool 26' in order to attach the sheet to the new reel spool by vacuum suction from within the reel spool. As the sheet is transferred to the new reel spool, the sheet is broken and the parent roll is kicked out to continue the winding process with a new reel spool.

Figure 3:
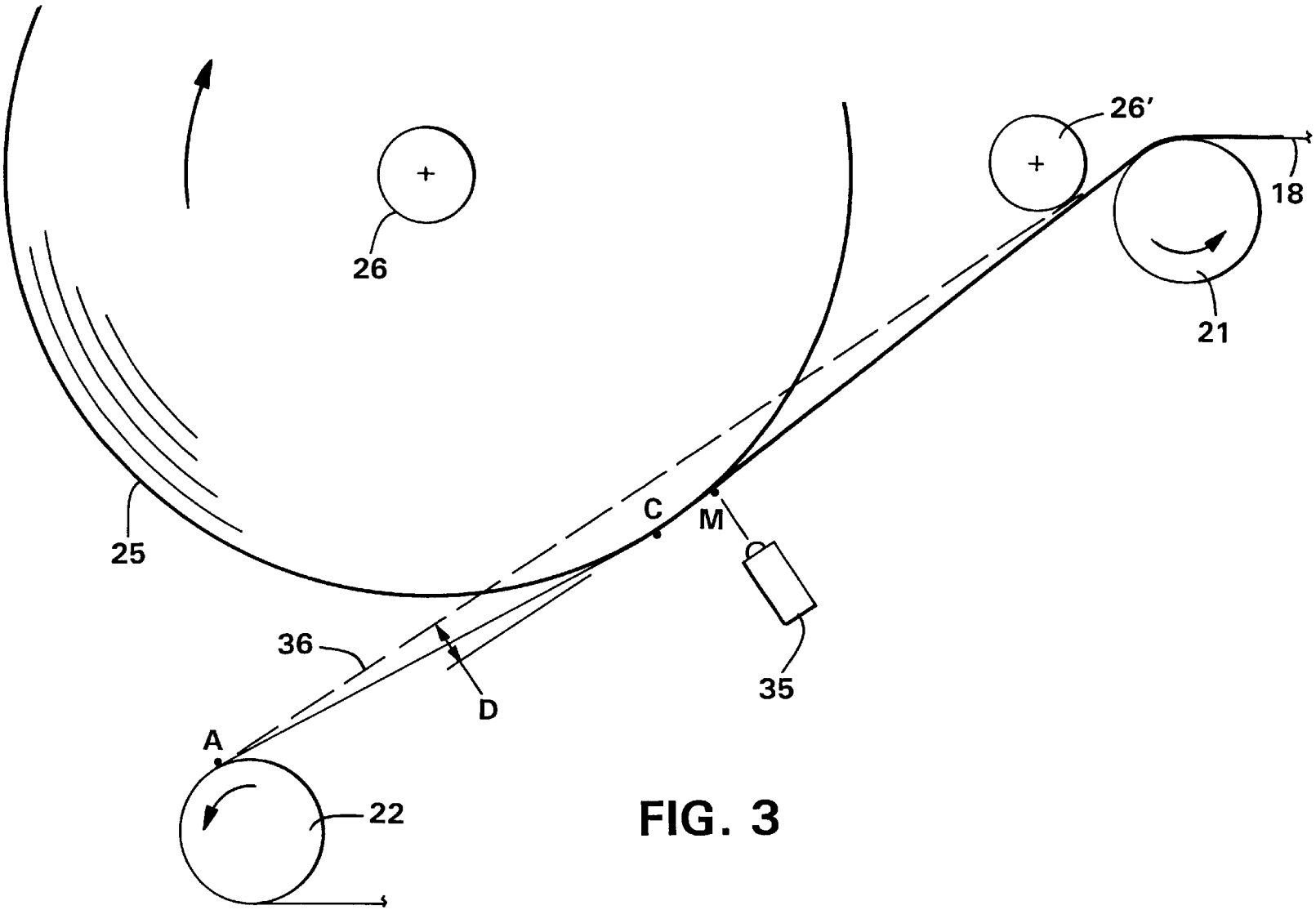
FIG. 3 is a schematic diagram of the winding section, illustrating the operation of a laser displacement sensor in controlling the transfer belt displacement.

Referring to FIG. 3, control of the relative positions of the reel spool 26 and the transfer belt 18 is suitably attained using a non-contacting sensing device 35 which is focused on the inside of the transfer belt, preferably at a point "M" midway between the two winding drums as shown. The object is to minimize and control the pressure exerted by the parent roll against the sheet supported by the transfer belt as well as minimize the nip length created by the contact. The sensing device, such as a laser displacement sensor, detects changes in transfer belt deflection of as small as 0.005 inches. (The undeflected line of travel of the transfer belt in the free span is identified by reference number 36.) Calculating the actual transfer belt deflection using the ratio of the distance from the winding drum tangent point "A" to the laser point "M" and the distance from the winding drum tangent point "A" to the center of the parent roll nip "C" has been discussed previously. If the amount of deflection "D" is outside a predetermined acceptable range, the sensor signals that the reel spool of the parent roll be repositioned accordingly. Mechanical and electrical apparatus for positioning the reel spool in response to the sensor input are not a part of this invention and suitable means for achieving this objective can be designed and constructed by those skilled in the art of building high speed winders. It has been found that optimal winding operation for soft, high bulk tissue sheets is attained when the transfer belt deflection is maintained between about 2 to about 6 millimeters. Maintaining the transfer belt deflection within this range has been found to allow the parent roll and the transfer to operate with a relative speed differential without significant power transfer. This will allow control of the winding process to maintain substantially constant sheet properties throughout the parent roll, which heretofore has not been possible for such sheets using conventional winders.

It will be appreciated that the foregoing description, given for purposes of illustration, is not intended to limit the scope of this invention, which is defined by the following claims and all equivalents thereto.

We claim:

1. A parent roll of tissue having a diameter of about 70 inches or greater, wherein the tissue taken from the roll has a bulk of 9 cubic centimeters or greater per gram, a finished basis weight coefficient of variation of about 2 percent or less and a machine direction stretch coefficient of variation of about 6percent or less.

2. The parent roll of claim 1 having a tissue bulk coefficient of variation of about 3.0 percent or less.

3. The parent roll of claim 1 having a tissue bulk coefficient of variation of about 2.0 percent or less.

4. The parent roll of claim 1 wherein the diameter of the parent roll is from about 100 to about 150 inches.

5. The parent roll of claim 1 wherein the finished basis weight coefficient of variation is about 1 percent or less.

6. The parent roll of claim 1 wherein the machine direction stretch coefficient of variation is about 4 percent or less.

7. The parent roll of claim 1 wherein the machine direction stretch coefficient of variation is about 3 percent or less.

* * * * *